United States Patent [19]

Meyer et al.

[11] Patent Number: 4,987,649

[45] Date of Patent: Jan. 29, 1991

[54] METHOD OF AUTOMATIC CONVEYANCE OF TEXTILE MATERIAL IN RECIPIENTS

[76] Inventors: Urs Meyer, Hohfurriste. 1, CH-8172 Niederglatt ZH, Switzerland; Niklaus Gartenmann, Breitestr. 90, CH-8400 Winterthur, Switzerland

[21] Appl. No.: 440,910

[22] Filed: Nov. 22, 1989

[30] Foreign Application Priority Data

Nov. 28, 1988 [CH] Switzerland ..... 4410/88

[51] Int. Cl.[5] ..... D01H 9/18

[52] U.S. Cl. ..... 19/159 A

[58] Field of Search ..... 19/159 A, 159 R, 300; 209/927; 364/470

[56] References Cited

U.S. PATENT DOCUMENTS

| | | | |
|---|---|---|---|
| 3,698,041 | 10/1972 | Hertzsch | 19/159 A |
| 3,884,026 | 5/1975 | Yoshizawa et al. | 19/159 A |
| 3,922,642 | 11/1975 | Tooka | 364/470 |
| 4,059,185 | 11/1977 | Weber | 19/159 A |
| 4,227,848 | 10/1980 | Kriechbaum et al. | 19/159 A |
| 4,443,913 | 4/1984 | Klazar | 19/159 A |
| 4,477,945 | 10/1984 | Vignon et al. | 19/159 A |
| 4,577,372 | 3/1986 | Roder | 19/159 A |
| 4,683,619 | 8/1987 | Langen et al. | 19/159 A |
| 4,697,310 | 10/1987 | Rauh | 19/159 A |

FOREIGN PATENT DOCUMENTS

| | | | |
|---|---|---|---|
| 0069087 | 1/1983 | European Pat. Off. | 19/159 A |
| 3707080 | 9/1988 | Fed. Rep. of Germany | 19/159 A |
| 0185826 | 9/1985 | Japan | 364/470 |

*Primary Examiner*—Werner H. Schroeder
*Assistant Examiner*—John Calvert
*Attorney, Agent, or Firm*—Dority & Manning

[57] ABSTRACT

A method of conveying textile material in recipients from a machine delivering textile material to a machine receiving textile material by means of a self-propelled conveying carriage (F) whose movements are controlled by a central control unit (Z). A disadvantage of the known systems is that despite the use of a self-propelled carriage for the between-machines transfer of the cans, fully automatic operation without manual intervention is impossible—i.e., some manual intervention is required at short intervals of time. According to the invention, therefore, the carriage (F) is controlled for the return of recipients (7) from the textile material receiving machine (S1, S2) to the textile material delivering machine (K1-K3) by the central control unit (Z) on the basis of control signals delivered thereto and that a checking station (L) is provided on the path of the carriage (F) from the textile material receiving machine (S1, S2) to the textile material delivering machine (K1, K3) to monitor the content and/or condition of the recipients on the carriage and is connected to the control unit (Z).

23 Claims, 4 Drawing Sheets

METHOD OF AUTOMATIC CONVEYANCE OF TEXTILE MATERIAL IN RECIPIENTS

The invention relates to a method of automatic conveyance of textile material in recipients as set out in the preamble of claim 1.

The automatic conveyance of textile material between the various machines of a spinning plant is becoming an increasingly important factor in improving productivity and quality.

For instance, DE-OS No. 3 532 172 discloses a system wherein the control of a conveying carriage, the card control means and the drawframe control means are linked to a central control unit. Also associated with this system is a buffer control adapted to receive full and empty cans and also linked to the central control unit.

It therefore becomes possible for the sliver-receiving machine which is disposed after a sliver-delivering machine to be supplied automatically with sliver-filled cans; the can is conveyed to the following machine by means of a conveying carriage running on a stationary guide track.

When in the known system sliver breakages occur, for example, on the drawframe, or when the can becomes unserviceable because of damage, manual intervention is necessary.

This system cannot therefore be left to run automatically and without manual intervention over a period of several hours and is rather a semi-automatic system in which various operation must be performed manually.

When, for example, the drawframe of the known system signals that a can is to be fetched, the corresponding can is fetched by the carriage and returned to the card. The automatic system has no provision of checking whether textile material is still present in the returned can. To avoid disturbances in operation when this can is refilled at the card, the can must be checked manually for content and functioning. This checking cannot be carried out during conveyance and must be carried out either at delivery to the card or at the drawframe before conveyance.

It is the object of the invention to propose a method and system wherein the conveyance of recipients conveying textile material is fully automatic and the necessary manual intervention is limited very considerably, being necessary only at long intervals, and recipient exchange takes only a short time.

This problem is solved by the method set out in the operative part of claim 1.

Advantageous developments of the method can be gathered from the subclaims following claim 1.

When the proposed method is used, in the event of a sliver breakage in a subsequent textile material receiving machine, for example, a drawframe, the corresponding can with the sliver remainder in it is supplied to a checking station after a reserve sliver has been fed in automatically from a reserve can associated with the defective can.

Depending upon the extent of can filling, either the can is emptied at the checking station or the sliver start is searched for by a search device and delivered to clamping and transfer means on the carriage or on the recipient for return to the drawframe.

The provision of relatively small stores for separated-out defective cans and serviceable cans to be fed in and of a store for textile material removed from the recipients helps to lengthen the intervals between manual intervention. Only occasional visual checks are needed during fully automatic operation.

When different materials, for example, cotton and polyester, are used, it is proposed that the textile material removed at the checking station be supplied to an intermediate store corresponding to the material. This operation is controlled by the central control unit which has detected and temporarily stored the position previously taken up on the drawframe by the can to be emptied.

Methods also proposed for monitoring recipient condition ensure that only serviceable cans or recipients are in use in the closed conveying system.

Immediately the proposed method or the corresponding facility detects a defective can in the checking station, the defective can is, as further proposed, replaced by a serviceable can present in a can store. The defective can is also delivered to a store and can be removed therefrom manually or automatically.

Can serviceability monitoring can be carried out by a system for monitoring external shape, for example, by monitoring the concentricity of circular cross-section recipients or in other cases by measuring the deflection of the spring supporting a can plate.

It is proposed to use a mechanical or suction extractor to remove any residue detected in the recipient. Both devices can be moved into a removal position and delivery position. In the delivery position the device transfers the removed textile material to an intermediate store before the material is supplied for reuse. Another possibility is to use instead of the suction extractor a blowing device for removing the residue from the can plate.

Other advantages will be described and illustrated in greater detail hereinafter with reference to the following embodiments.

Figure 1:
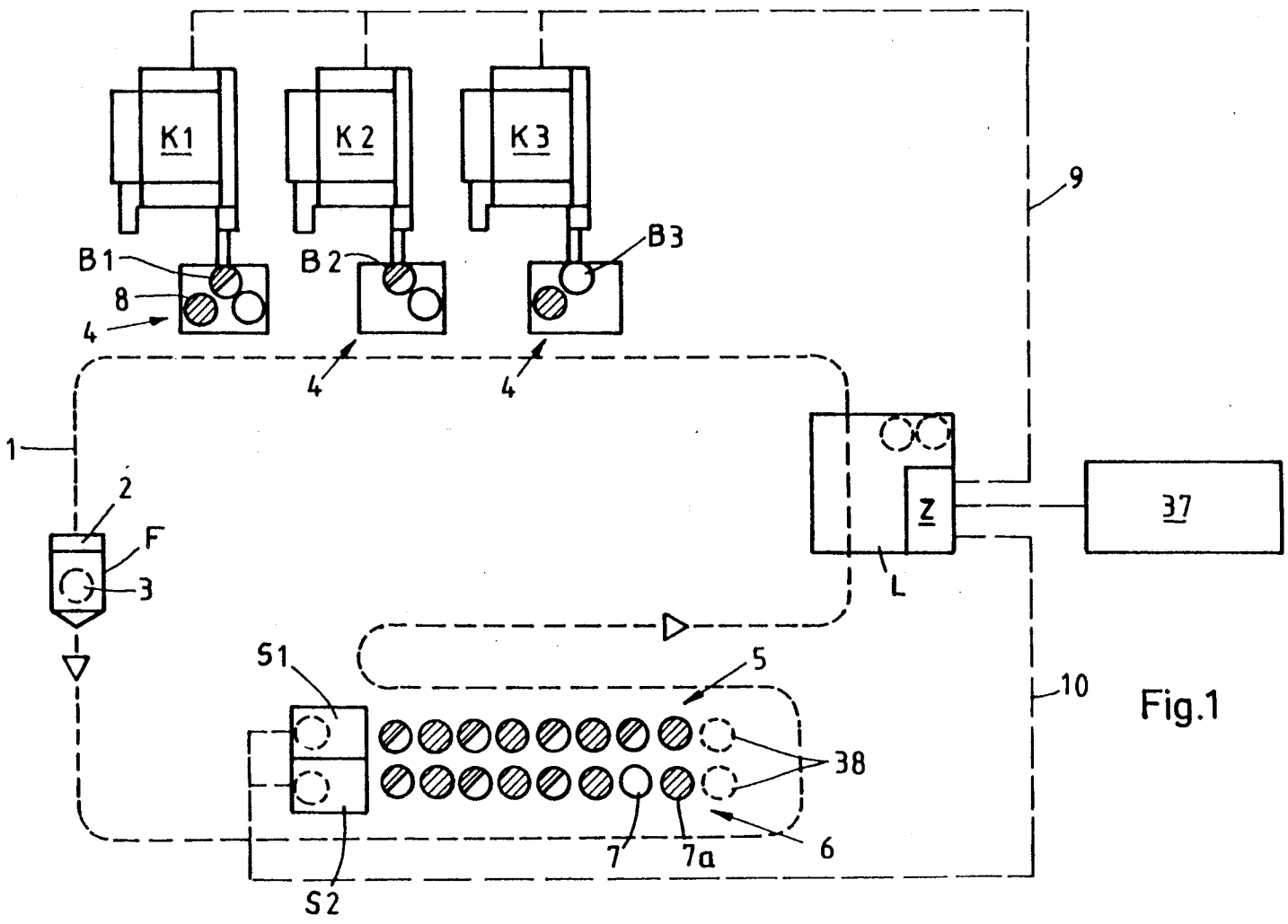
FIG. 1 is a diagrammatic plan view of a spinning preparation facility having three cards and two drawframes and a movable can conveyor.

Referring to FIG. 1, three cards K1 to K3 are disposed in line. The sliver produced on the cards is place by of a funnel wheel in cans B1 to B3. The cards have in addition to the sliver-receiving can other places for empty and full cans. The latter places are effective as a kind of buffer. In the example shown there is one place for a full can and one place for an empty can, but further can places can be provided.

Disposed after the cards K1 to K3 are two drawframes S1, S2 which further process the textile material delivered by the cards. The cards K1 to K3 are linked with the drawframes S1, S2 by a conveyor embodied by a carriage F running on a guide track 1. The carriage F has drive means (not further shown) and steering means, the latter controlled by sensors which sense the track 1.

The carriage F can be guided by some other system, such as a rail system.

The carriage F also has a can place 3 and a computer 2. The computer 2 is effective to record and process routing instructions received from a central control unit Z and is also responsible for controlling can loading and unloading and for the steering mechanism.

The carriage F can have further can places.

A checking station L is disposed, referred to the route of the carriage F, between the drawframes S1, S2 and the cards K1 to K3.

In the example shown the carriage moves in only one direction and travels, after it has passed delivery stations 4 of cards K1 to K3, along the creels 5, 6 of the drawframes S1, S2 before reaching the checking station L. The transport loop is closed after the carriage F has passed the checking station L and returns to delivery stations 4 of cards K1 to K3.

The checking station L has a central control unit Z linked for control purposes by way of cables 9, 10 to the cards K1–K3 and drawframes S1, S2. For inclusion in the overall process control the unit Z can be linked with an overriding central computer 37.

The unit Z could be disposed away from the station L anywhere in the conveying system.

Information is derived by way of the link 9 about can place occupany of the delivery station 4 of the cards K1 to K3 and by way of the link 10 the central control unit Z receives information from the drawframes S1, S2 when a can in the creel 5, 6 has run out or no sliver is present because of a sliver break. Both events—i.e., the sliver breakage and an empty can—trigger the same signal.

In the example shown in FIG. 1, there has been a report by way of the link 10 from the drawframe S2 that can 7 in the creel 6 has run out. The reserve sliver of the reserve can 7*a* has been pieced up automatically by way of a feed-in device not further shown. The central control unit Z transmits to the carriage F originally present in a wait position at the checking station L the instruction to approach the creel 6 in order to fetch the empty can 7 thereof.

For an accurate approach to the can places the same can have discrete sensors or markings co-operating with the drive means of the carriage F by way of sensors thereon.

After the can 7 has been received by way of a can-handling facility not further shown, the carriage F with empty can 7 enters the checking station L.

The can 58 on the carriage F is checked at the checking station (FIG. 3) by way of a level gauge 11 to see whether textile material 45 is still present in the can.

Figure 3:
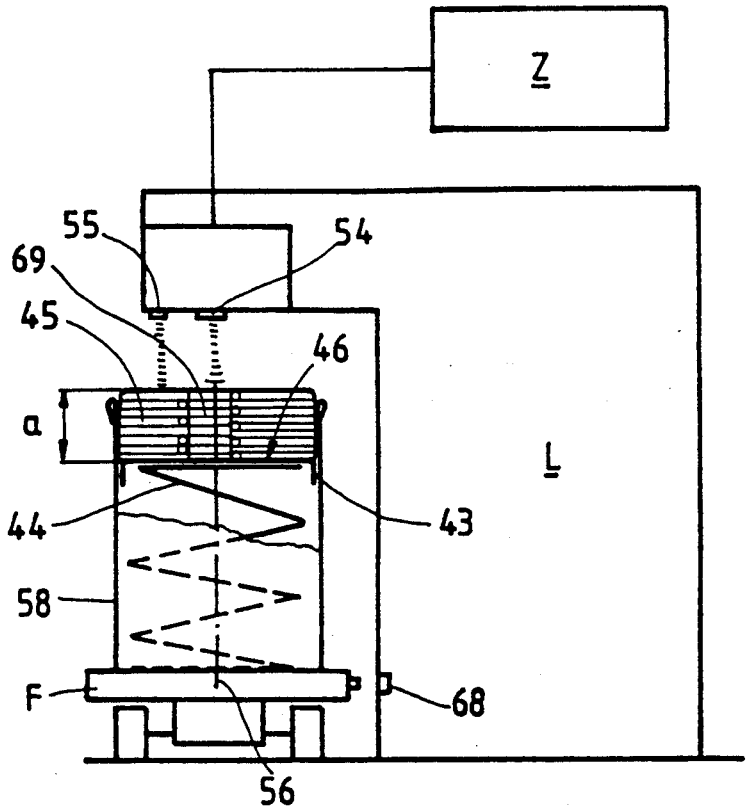
FIG. 3 is a diagrammatic view of a checking station in accordance with FIG. 1 and having a can content checking facility.

Referring to FIG. 3, in the example shown two optical sensors 54, 55 disposed above the can 58. While being checked at the checking station the carriage F has been postioned by means of a position sensor 68 in a predetermined position. Other positioning elements, of example, mechanical interlocks or the like, can be used.

As can be gathered from FIG. 3, a can coiler 45 of height a is also disposed in the can 58. The coiler 45 is disposed on top surface 46 of a can plate or turntable 43 which bears by way of a spring 44 on the bottom of the can. To suit conventional overcentre coiler can delivery, the sliver being delivered over the centre of the central axis 56, a cylindrical space 69 is present in the middle of the coiler. The sensor 54 is disposed exactly above the space 69 and can therefore sense the height of the can plate top surface 46. The other sensor 55 is aligned on the coiler 45 and senses the top boundary thereof.

Coiler height a can be determined by adding or subtracting the two signals of the sensors 54, 55. This calculated value a is compared with a predetermined limit value in an electrical circuit arrangement not shown in greater detail.

When the value a is greater than the predetermined limit value a sliver end search facility is brought into operation.

Figure 4:
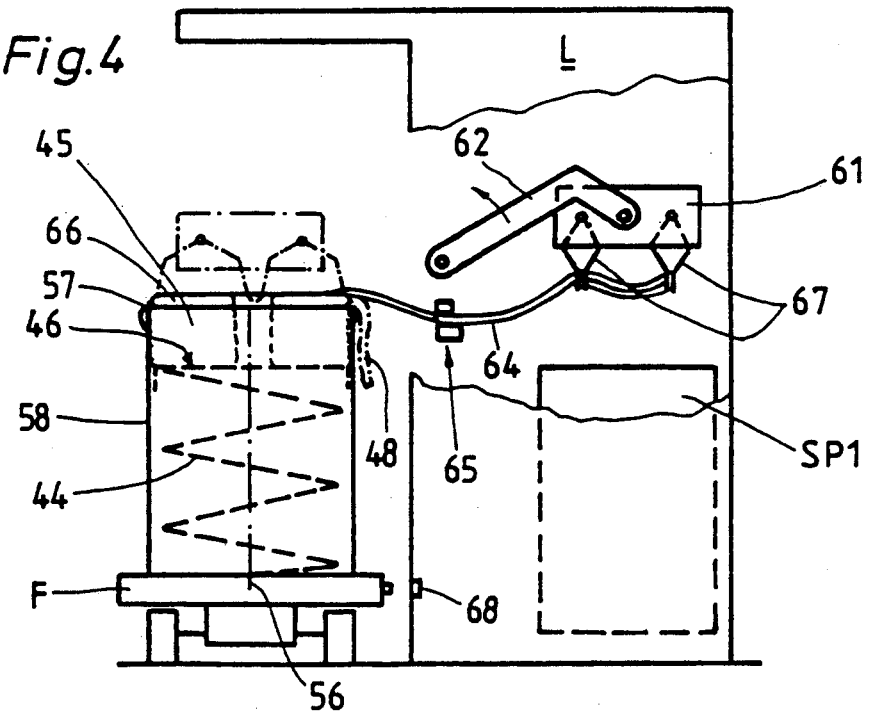
FIG. 4 is a diagrammatic view of a checking station according to FIG. 1 with a facility for searching for the sliver end.

FIG. 4 shows an embodiment of such a search facility, in the form of a gripper 61 pivotable by way of pivoted arms 62 into a position above the coiler 45. The drive of the arms 62 is not shown in greater detail and can be effected in known manner. This position of the gripper 61 is shown in chain-dotted line. The gripper 61 has two gripper tongs 67 and before the top layer 66 of the coiler 45 is engaged one arm of the tongs 67 is near the can edge 57 and the other arm is near the space 69. The gripper 61 is therefore disposed in vertically spaced-apart relationship to the top layer 66 of the coiler 45 so that when the tongs 67 close the top layer 66 is engaged. The term "top layer 66" is to be understood as denoting from one to four layers, disposed one above another, of delivered sliver loops.

When the tongs 67 are in the closed state, the gripper 61 is pivoted into the position shown by means of the pivoted arm 62 with the retained top layer 66. This pivoting moves not only the clamped part of the top layer 66 but also becuse of the translational movement draws further sliver out of the coiler 45. A connecting piece in the form of a free hanging sliver 64 therefore arises between the removed top layer 66 clamped in the tongs 67 and the coiler 45 which has remained in the can.

The connecting piece 64 or the discrete sliver is engaged by a cutting device 65, which can have sensors (not further shown) signalling or monitoring the presence of the sliver 64.

The cutting device 65 severs the sliver 64 at a predetermined place so that the resulting sliver end 48 hangs down over the can edge. It is therefore a simple matter for a following detector facility to detect this sliver at this predetermined position for automatic joining to the following drawframe.

Another possibility, which is not shown, is to detect the sliver end 48 immediately after severance by a sliver gripper on the vehicle, the sliver gripper joining the end 48 automatically to the subsequent drawframe.

The other end of the severed sliver and the removed top layer 66 are delivered to a store SP1 as a result of the tongs 67 opening. The material collected can be supplied to a subsequent re-utilization process.

When coiler height a is less than the predetermined limit value, mechanical gripping means (not shown) or suction means operate to remove from the can 58 the entire coiler 45 which has remained therein and to take it to the store SP1. The gripper means can be of similar construction to what has been hereinbefore described in connection with searching for the sliver end. It is always advantageous, even when can content monitoring reveals that there is no more material on the can plate 43, to clean the surface thereof with a suction device in order to remove any sliver residues or fly. The can plate could be cleaned by blowing instead of by suction extraction.

Can content monitoring and the gripper device 61 for removing the top layer 66 can be combined in a single unit.

The intention is for sliver end searching to be repeated a number of times if the end is not discovered the first or second time. Searching can be limited to a predetermined number of repeats and when this limit has been reached a control operates to initiate removal of the complete coiler which has remained in the can.

When the system detects that the sliver end has been found and delivered after severance to a predetermined position on the can, this can 58 is conveyed for further processing directly to one of the two paths S1 or S2 when the central control unit Z reports a corresponding requirement.

Figure 5:
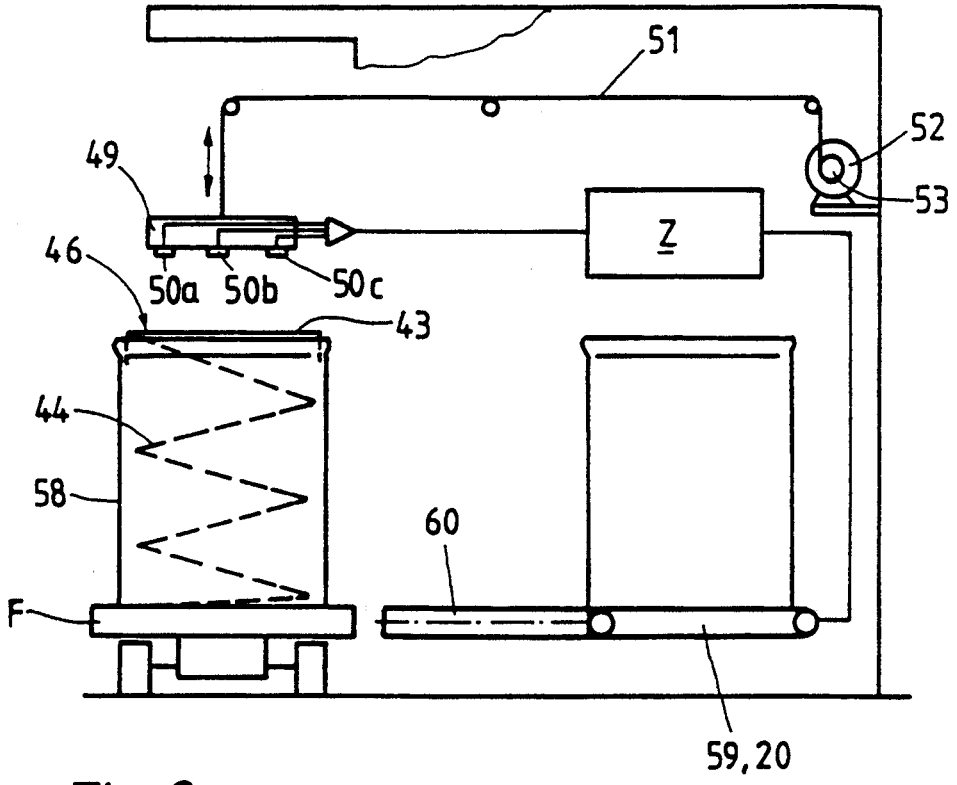
FIG. 5 is a diagrammatic elevation of a checking station according to FIG. 1 having a facility for monitoring the functioning of a can turntable.
Figure 6:
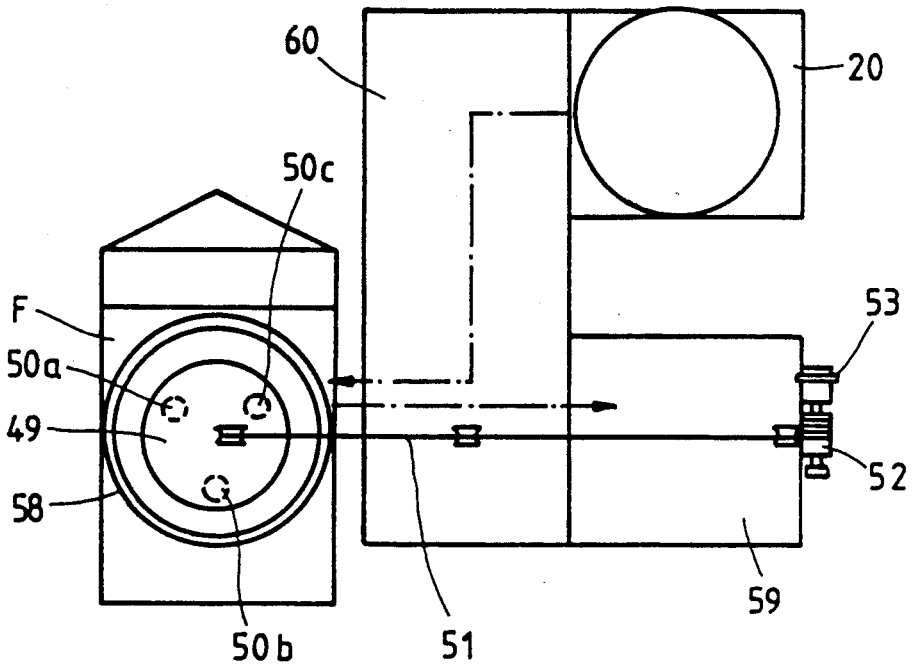
FIG. 6 is a diagrammatic plan view corresponding to FIG. 5 showing storage places for empty reserve cans and defective cans.

When there is no more material on the can plate 43, the operation of the can or can plate 43 can be monitored by means of a checking facility forming part of the checking station. For this purpose, and as shown in FIG. 5, a weight adapted to be raised and lowered by way of a pull rope or cable or the like 51 is disposed above the can plate 43. The rope 51 is wound and unwound by a motor 53 by way of a cable or rope drum 52 to move the weight 49. Load cells 50*a*, 50*b*, 50*c* are distributed around the periphery of the weight 49 on its underside, as can be seen in FIG. 6. When the weight 49 descends the cells engage the can plate top surface 46. As the weight 49 descends further the can plate 43 is pressed down against the force of the spring 44. The force/distance curve detected by the cells 50*a*, 50*b*, 50*c* is compared with a predetermined curve and is a measure of can seviceability. For example, if the can has a dent on its periphery, the can plate 43 would become skewed at this position and values of the individual cells would differ considerably from one another. In this case the system determines that the can is defective, whereupon a control is triggered which initiates movement of the defective can 58 into a store 59, followed by the supply of a new empty and intact can from an empty can store 20 by way of a transverse conveyor 60 to the can position on the carriage. The drive for the conveying elements which is associated with the stores 20, 59 and the transverse conveyor 60 is controlled by the controlled unit Z, as indicated by a connecting line.

Another possible way of monitoring can serviceability is sensing (not shown) the circular can casing as a check on can concentricity.

When a coiler 45 is still present on the can plate 43 and the top layer 66 is at a distance from the top can edge 57, either the can plate 43 has jammed in the can or the spring 44 is defective. This condition can be detected by means of the can content monitoring facility of FIG. 3 and therefore also provides a possibility of monitoring can serviceability.

If the serviceability check shows that the can 58 is satisfactory, the can can be delivered by means of the carriage F at a position determined by the system at one of the cards K1 to K3. In the present example the carriage F is in a wait position at the checking station L and is receiving a movement instruction from the central control unit Z which in this case is integrated with the checking station.

By virtue of the signal transmitted at the checking station L to the carriage F that the full can 8 of the card K1 is ready for fetching, the carriage F moves to this delivery station 4 of the card K1 and takes over the full can 8. The same is then transferred to the original position of the can 7 in the creel 6 of the drawframe S2. After delivering the can 8 the carriage F returns to its wait position in the checking station L.

The wait position and the siting of the central control unit could be anywhere else in the conveying system.

Another possibility is to provide on each of the creels 5, 6 an empty can place 38 shown in chain lines. This helps to obviate an idle trip of the carriage F—i.e., on its way from the checking station L to the drawframe S2 the carriage F can take over a full can 8 from the card K1 and deposit it at the empty place 38 of the drawframe S2. If the carriage F has limited provision for reversal, the empty can 7 can be taken up after deposition of the full can 8 and transferred to the checking station L.

While the carriage is present at the checking station L the temporarily stored signals "fetch can" or "bring can" are transmitted to the carriage computer 2 and so the route for the can places to be approached is determined.

Figure 2:
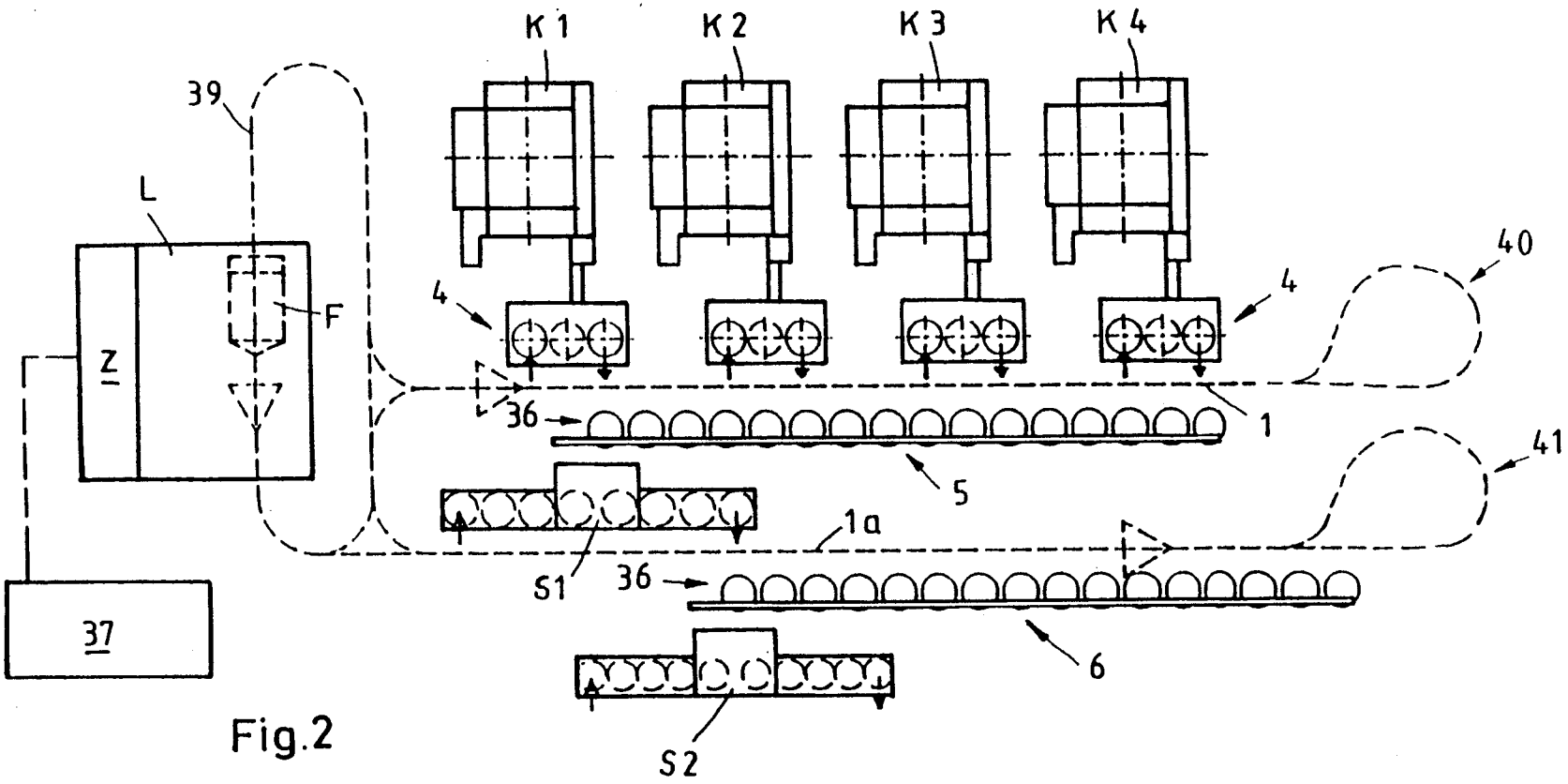
FIG. 2 shows another embodiment in accordance with FIG. 1.

FIG. 2 shows another embodiment in which the routes between the drawframe and the card overlap to some extent and four textile material delivering cards K1–K4 delivering to one textile material receiving drawframe S1 are provided.

By way of a further guide track 1*a* the drawframe S1 is connected to a subsequent drawframe S2, the track 1*a* extending in a loop 39 to the track 1. The loop 39 comprises the checking station L.

There is a common track between the cards K1–K4 and the creel 5 of the drawframe S1 while at the end remote from the loop 39 there is another track loop 40 for reversing or returning the carriage F to the checking station.

The other track 1*a* has a reversing loop 41.

The arrangement proposed cuts to a minimum the time required for can changing at the control station.

Since the delivery stations 4 of the cards K1–K4 and the receiving stations 36 are parallel to one another, the full cans can be transferred rapidly and directly to the receiving stations of the creel 5.

The further connection of a subsequent drawframe S2 further relieves the loading of the installed checking station.

Advantageously, a second carriage is used in the case.

The conveying system could include a battery exchange station for carriage battery exchange.

We claim:

1. A method of conveying textile material in recipients (7, 8) from a machine delivering textile material to a machine receiving textile material by means of a self-propelled conveying carriage (F) whose movements are contolled by a central control unit (Z) connected to the textile material delivering machines (K1–K3) and to the textile material receiving machines (S1, S2), characterised in that the carriage (F) is controlled for the return of recipients (7) from the textile material receiving machine (S1, S2) to the textile material delivering machine (K1–K3) by the central control unit (Z) on the basis of control signals delivered thereto, and a checking station (L) is provided on the path of the carriage (F) from the textile material receiving machine (S1, S2) to the textile material delivering machine (K1–K3) to monitor the content and/or condition of the or each recipient (58) on the carriage (F) and is connected to the control unit (Z).

2. A method according to claim 1, characterised in that the position of a can plate (43), which bears in the recipient (58) with spring biasing, and the top surface of the textile material (45) resting on the can plate (43) are sensed in order to monitor recipient contents.

3. A method according to claim 2, characterised in that if the recipient (58) is found to be partly empty to an extent not exceeding a predetermined extent of emptying, the recipient (58) is returned by way of the carriage (F) to the textile material receiving machine (S1, S2).

4. A method according to claim 2, characterised in that if the recipient (58) is found to be partly empty to an extent exceeding a predetermined emptying extent, the residue of textile material (45) in the recipient (58) is removed by way of a removal or emptying facility.

5. A method according to claim 4, characterised in that the removed remainder is delivered to a store (SP1, SP2), then supplied to a reutilization process.

6. A method according to claim 3, characterised in that the textile material is in the form of a sliver (47) and the sliver end (48) of the ascertained residue (45) is searched for by means of a device and delivered to a predetermined position.

7. A method according to claim 6, characterised in that the search for the sliver end (48) is effected one or more times and if such end fails to be detected after a predetermined number of searches, the remainder in the receptacle (58) is removed and supplied to a reutilization process.

8. A method according to claim 1, characterised in that the recipients (58) are of circular cross-section and their concentricity is monitored by way of a sensing device.

9. A method according to claim 8, characterised in that for monitoring of its concentricity the recipient (58) is rotated around its vertical axis (56) at a predetermined distance from a stationary sensor and guided in its horizontal position by means of a positive centring.

10. An apparatus according to claim 1, characterised in that recipient condition is monitored by serviceability checking of the can plate (43) or of the spring (44) bearing thereon by way of a pressure/distance pickup which acts downwardly on the can plate (43).

11. An apparatus according to claim 10, characterised in that by means of a weight unit (49) which can be infed downwardly by way of a pull rope (51) or the like towards the can plate (43), at least three load cells (50*a*, 50*b*, 50*c*) secured to the underside of the weight unit (49) can engage the top of the can plate (43) and, upon further lowing of the weight unit (49) against the force of the spring (44), the sum of the force/distance curves detected during further lowering by the load cells (50*a*, 50*b*, 50*c*) can be compared with a predetermined set-value curve.

12. A method according to claim 1, characterised in that recipient condition is monitored by sensing the position of the surface (46) of a can plate (43) born in the recipient (58) by way of at least one spring element (44) as compared with sensing of the top edge (57) of the recipient well when there is no textile material (45) present in the recipient (58).

13. A method according to any of claim 1–12, characterised in that the recipient (58) remains on the carriage (F) during checking at the checking station (L).

14. A method according to claim 1, characterised in that recipient condition is monitored at a predetermined time interval.

15. An apparatus according to claim 2, characterised in that the checking station (L) has at least two optical sensors (54, 55) which are either fixedly installed or pivotable, one sensor (54) being provided to sense the position of the can plate (43, 46) in the sensing operation and being disposed near the central axis (56) and above the recipient (58), while the other sensor (55) is disposed in a zone between the central axis (56) and the outer edge (57) above the recipient (58) in order to sense the top layer (66) of textile material still in the recipient (58).

16. An apparatus according to claim 2, characterised in that the checking station (L) above the recipient (58) supplied by the conveyor (F) has a fixedly installed or infeedable ultrasonic sensor for monitoring can contents.

17. An apparatus according to claim 5, characterised in that the residue of textile material (45) is removed by means of an infeedable suction extractor.

18. An apparatus according to claim 5, characterised in that the residue of textile material (45) is removed by way of a mechanical gripper device.

19. An apparatus according to the method according to any of claims 8–12 or 14, characterised in that a receptacle store (20, 59) is associated with the checking station (L) and has supply and removal means for receiving defective recipients (59) and for delivering serviceable recipients (20) to the carriage (F).

20. An apparatus according to the method according to any of claims 4 or 5 or 7, characterised in that at least two displaceable or rotatable stores (SP1, SP2) for receiving the delivered textile material are associated with the checking station (L) and the corresponding infeeding of the store (SP1, SP2) to deliver or receive is controlled by the central control unit (Z).

21. An apparatus according to the method according to claim 6, characterised in that the top layer (66) of the coiled sliver (45) is removed by a pivotable or displaceable mechanical device (61) or by a suction device from the recipient (58) and displaced or pivoted horizontally, and means (65) for positioned severance of the sliver (47) engage near the connecting part (64) in the form of a discrete sliver (47) which has arisen near between the coil (45) which has remained in the recipient (58) and the removed top layer (66) of the coiler (45).

22. An apparatus according to claim 21, characterised in that the severed end (48) of the sliver (47) connected to the coil (45) which has remained in the recipient (58) is released by the cutting device (65) and moved into a position in which a predetermined length hangs down externally over the recipient edge (57).

23. An apparatus according to claim 21, characterised in that the severed end (48) of the sliver (47) is delivered by a device to retaining means of the carriage (F) or recipient (58).

* * * * *